US008065840B2

(12) United States Patent
Zaidi

(10) Patent No.: US 8,065,840 B2
(45) Date of Patent: Nov. 29, 2011

(54) MODULAR BUILDING CONSTRUCTION SYSTEM AND METHOD OF CONSTRUCTING

(76) Inventor: Syed Azmat Ali Zaidi, Arlington, VA (US)

( * ) Notice: Subject to any disclaimer, the term of this patent is extended or adjusted under 35 U.S.C. 154(b) by 94 days.

(21) Appl. No.: 12/385,348

(22) Filed: Apr. 6, 2009

(65) Prior Publication Data

US 2010/0269420 A1 Oct. 28, 2010

(51) Int. Cl.
*E04H 1/00* (2006.01)

(52) U.S. Cl. ..... 52/79.9; 52/79.1; 52/270; 52/284; 52/309.4; 52/745.1; 52/745.13; 52/745.08; 52/745.16; 446/110; 446/476

(58) Field of Classification Search ..... 52/79.1, 52/79.7, 79.9, 91.1, 270, 271, 284, 745.08, 52/745.1, 745.13, 745.16, 309.4; 434/79; 446/108, 110, 115, 476
See application file for complete search history.

(56) References Cited

U.S. PATENT DOCUMENTS

| | | | | | |
|---|---|---|---|---|---|
| 2,287,229 | A | * | 6/1942 | Carpenter | 52/79.9 |
| 2,691,291 | A | * | 10/1954 | Henderson | 52/79.9 |
| 2,904,927 | A | * | 9/1959 | Alexander | 446/105 |
| 3,462,897 | A | * | 8/1969 | Weinrott | 52/169.14 |
| 3,577,672 | A | * | 5/1971 | Nutting | 446/85 |
| 3,729,875 | A | * | 5/1973 | Felson | 52/79.7 |
| 3,822,569 | A | * | 7/1974 | Lautrup-Larsen | 446/85 |
| 4,010,579 | A | * | 3/1977 | Galvagni | 52/79.8 |
| 4,270,303 | A | * | 6/1981 | Xanthopoulos et al. | 446/115 |
| 4,628,650 | A | * | 12/1986 | Parker | 52/265 |
| 5,758,461 | A | * | 6/1998 | McManus | 52/293.3 |
| 5,761,862 | A | * | 6/1998 | Hendershot et al. | 52/271 |
| 6,076,319 | A | * | 6/2000 | Hendershot et al. | 52/271 |
| 6,584,740 | B2 | * | 7/2003 | Record | 52/270 |
| 6,701,678 | B1 | * | 3/2004 | Skov et al. | 52/79.9 |
| 6,802,158 | B1 | * | 10/2004 | Greene | 52/79.5 |
| 6,854,218 | B2 | * | 2/2005 | Weiss | 52/79.1 |
| 7,204,060 | B2 | * | 4/2007 | Hunt | 52/284 |
| 7,395,634 | B2 | * | 7/2008 | Anderson et al. | 52/79.1 |
| 7,543,411 | B2 | * | 6/2009 | Whitehead et al. | 52/66 |
| 7,581,357 | B2 | * | 9/2009 | Richardson et al. | 52/79.5 |
| 7,658,038 | B2 | * | 2/2010 | Mower et al. | 52/79.1 |
| 7,779,579 | B2 | * | 8/2010 | Mower et al. | 52/79.1 |
| 7,797,885 | B2 | * | 9/2010 | Mower et al. | 52/79.6 |
| 7,797,897 | B2 | * | 9/2010 | Roth | 52/282.3 |
| 2002/0174606 | A1 | * | 11/2002 | Hunt | 52/79.1 |
| 2003/0033769 | A1 | * | 2/2003 | Record | 52/270 |
| 2004/0107652 | A1 | * | 6/2004 | Elliott | 52/79.1 |
| 2004/0187400 | A1 | * | 9/2004 | Anderson et al. | 52/79.1 |
| 2005/0016082 | A1 | * | 1/2005 | Agaiby | 52/79.1 |
| 2005/0223653 | A1 | * | 10/2005 | Mower et al. | 52/79.1 |
| 2007/0044391 | A1 | * | 3/2007 | Richardson et al. | 52/79.1 |
| 2007/0056223 | A9 | * | 3/2007 | Hunt | 52/79.1 |
| 2007/0209295 | A1 | * | 9/2007 | Mower et al. | 52/79.1 |
| 2009/0300999 | A1 | * | 12/2009 | Ferriere | 52/79.9 |
| 2010/0205871 | A1 | * | 8/2010 | Mower et al. | 52/79.12 |
| 2010/0293885 | A1 | * | 11/2010 | Ceccotti et al. | 52/745.13 |
| 2010/0325971 | A1 | * | 12/2010 | Leahy | 52/79.1 |
| 2011/0011010 | A1 | * | 1/2011 | Mower et al. | 52/79.5 |

FOREIGN PATENT DOCUMENTS

| | | | |
|---|---|---|---|
| GB | 2 275 944 | A * | 9/1984 |
| JP | 2-282537 | * | 11/1990 |
| JP | 6-73822 | * | 3/1994 |
| WO | 94/19558 | * | 9/1994 |

* cited by examiner

*Primary Examiner* — Robert Canfield

(57) ABSTRACT

A modular building construction system including a plurality of free-standing, molded polymer components that may be assembled to form a weatherproof structure. Components include a center, corner, interior passageway, door, and roof panels, as well as supporting beams that may be arranged in a nearly infinite number of configurations to easily, quickly and inexpensively form nearly any structure desired by the user.

13 Claims, 8 Drawing Sheets

MODULAR BUILDING CONSTRUCTION SYSTEM AND METHOD OF CONSTRUCTING

CROSS-REFERENCE TO RELATED APPLICATIONS

NOT APPLICABLE

STATEMENT REGARDING FEDERALLY SPONSORED RESEARCH OR DEVELOPMENT

NOT APPLICABLE

INCORPORATED-BY-REFERENCE OF MATERIAL SUBMITTED ON A COMPACT DISC

NOT APPLICABLE

BACKGROUND OF THE INVENTION (1) Field of the Invention

This invention is directed to building construction system involving interlocking components made of relatively rigid, light weight material.

Traditionally, buildings are constructed of concrete, steel, wood frame or masonry block by assembling the individual components and joining them by appropriate means to form exterior walls, internal frame, and panels of drywall attached thereto, forming the interior walls. This is a laborious and time consuming process, providing much possibility of errors resulting in cracks or holes detracting from the effectiveness of the walls.

It is, therefore, an object of the present invention to provide a building construction system which involves interlocking components made of relatively rigid, lightweight material. Each component comprises an entire section of wall or roof panel, that is exterior walls and interior walls, as well as windows, doors, etc. Each panel fits interlocking to the adjacent panel. Depending on the number and nature of the assembled panels, a large variety of building types, shapes and sizes can be constructed to satisfy numerous functions, residential, institutional, health care, commercial, etc.

(2) Description of Related Art

Applicant is aware of no prior art directly relevant to the present invention.

BRIEF SUMMARY OF THE INVENTION

In accordance with the present invention, a construction system comprises interlocking components made of relatively rigid light weight material such as extruded or expanded polystyrene. The components include an exterior wall and an interior wall, and some include windows or doors. The component panels can be joined and interlocked in various combinations so as to provide a building of various different types, shapes and sizes to satisfy various numerous functions.

DETAILED DESCRIPTION OF THE DRAWINGS

Reference will now be made to the preferred embodiment of the invention as illustrated in the accompanying drawings.

Figure 1:
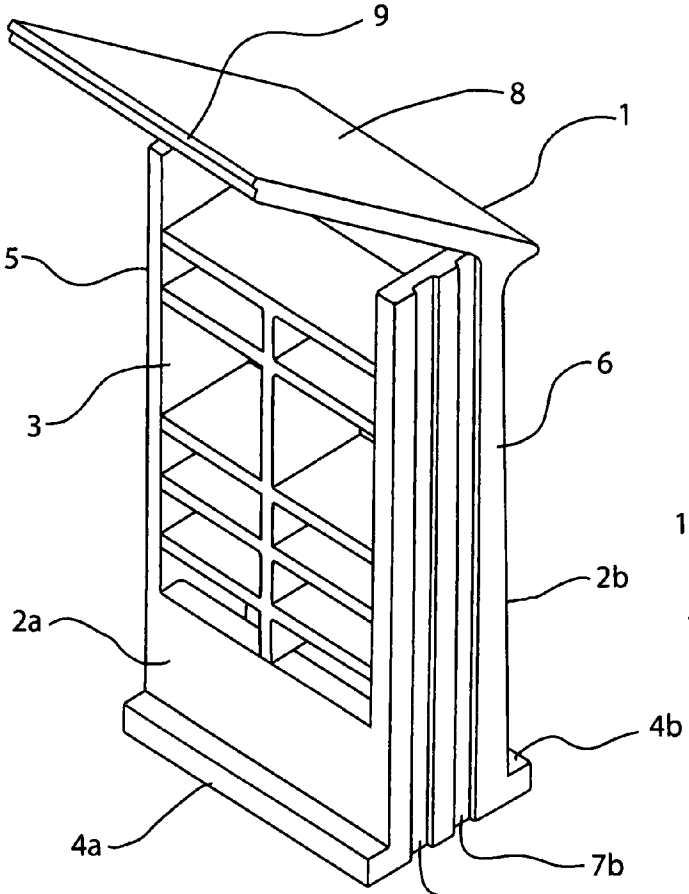
FIG. 1 is a side perspective view of a center panel with shelves

A center panel 1, as illustrated in FIG. 1, includes an exterior wall 2*b*, and an interior wall 2*a*. Shelves 3 are formed in interior wall 2. Footings 4*a* and 4*b* are formed at the bottom of walls 1 and 2 and extend horizontally outward therefrom. When in place the footings would normally be covered with earth and sod. Each of the sides 5 and 6 that extend between walls 1 and 2, include lateral channels 7*a* and 7*b* formed parallel to walls 1 and 2. Channels 7*a* and 7*b* are for the purpose of accommodating corresponding protrusions in an adjacent panel. A roof portion 8 extends upwardly from exterior wall 1. At its upper end, an overlap 9 is formed, to accommodate a corresponding underlap in the adjacent roof panel.

Figure 2:
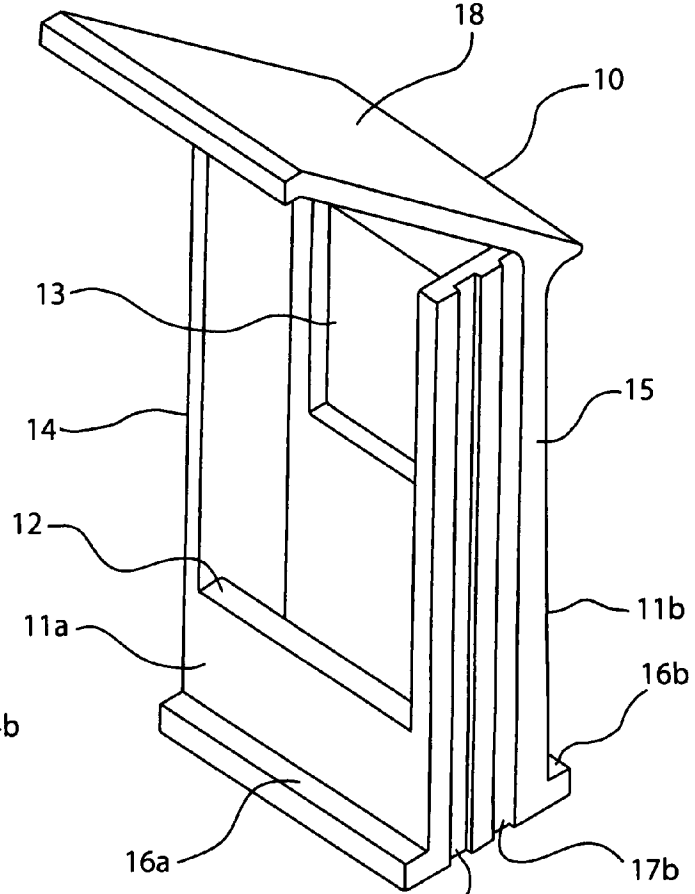
FIG. 2 is a side perspective view of a window panel.

A window panel 10, as illustrated in FIG. 2, includes an exterior wall 11*b* and an interior wall 11*a* extends up only to the floor level 12. A window 13 is formed in the exterior wall 11*b*. Footings 16*a* and 16*b* are formed at the bottom of walls 11*a* and 11*b*. Each of the sides 14 and 15 that extend between walls 11*a* and 11*b* include lateral channels 17*a* and 17*b* formed parallel to walls 11*a* and 11*b*. Channels 17*a* and 17*b* are for the purpose of accommodating corresponding protrusions in an adjacent panel. A roof portion 18 extends upwardly from exterior wall 11*b*.

Figure 3:
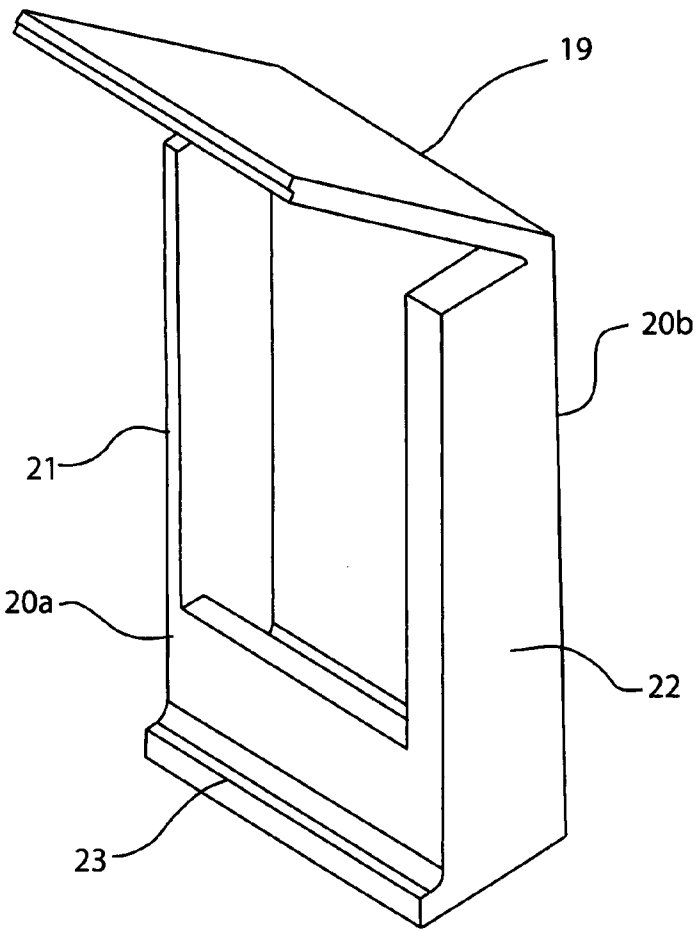
FIG. 3 is a side perspective view of a panel forming an interior passageway

FIG. 3 illustrates a panel 19 for forming an interior passageway. Its positioning relative to other panels is best understood from reference to FIG. 13. This panel 19 has an interior wall 20*a* and an exterior wall 20*b*. It has sides 21 and 22. It has footer 23. Side 21 has lateral channels, similar to those shown in FIG. 1 and FIG. 2 to facilitate interlocking with adjacent panels. But side 22 has no channels; it is solid and smooth since it forms half of an interior passageway. The other half is formed by a panel identical to FIG. 3 but with the sides reversed so that the solid smooth side is opposite side 22. Its other side has the interlocking channels.

Figure 4:
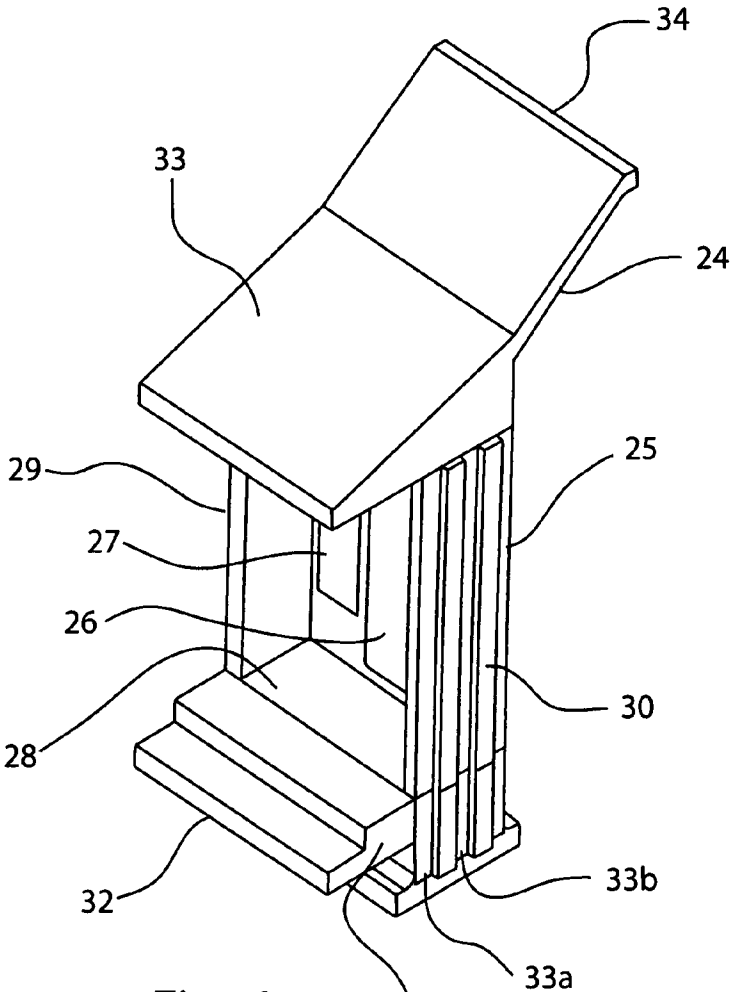
FIG. 4 is a side perspective view of a door panel

The door panel 24 illustrated in FIG. 4 has an interior wall 25, which includes a door 24 and adjacent window 27. A floor 28 extends between sides 29 and 30. Steps 31 extend out from floor 28 and just above ground level 32. Channels 33*a* and 33*b* are formed in side 30 parallel to wall 25, and for the purpose of accommodating corresponding protrusions in an adjacent panel. Similar channels are formed in side 29. A roof portion 33 is above sides 29 and 30, as well interior wall 25. The upper end 34 forms a butt joint against the adjacent roof panel.

Figure 6:
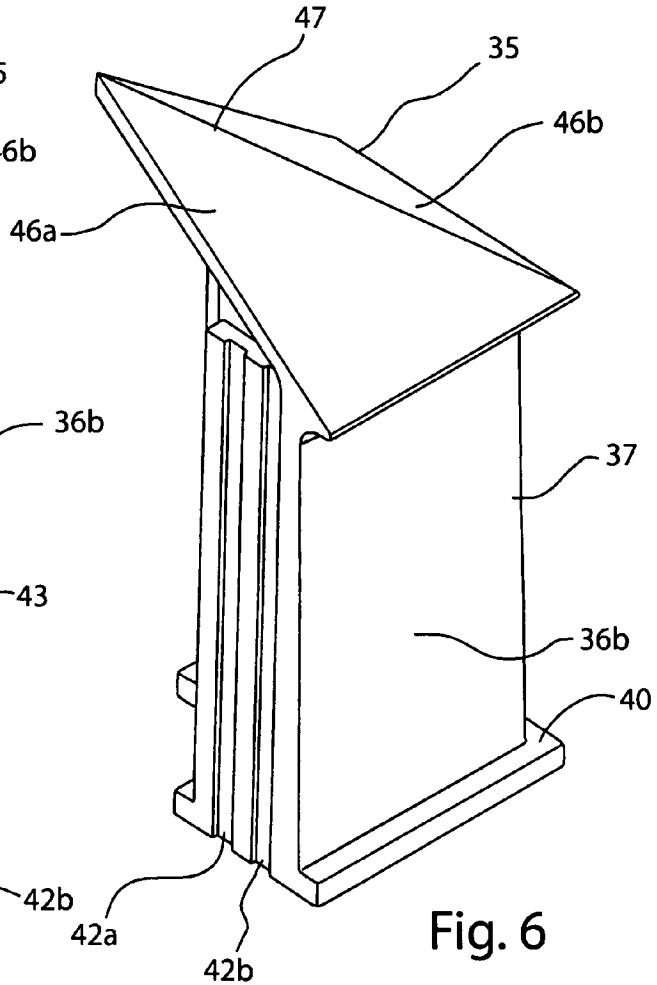
FIG. 6 is an outside perspective view of a corner panel
Figure 5:
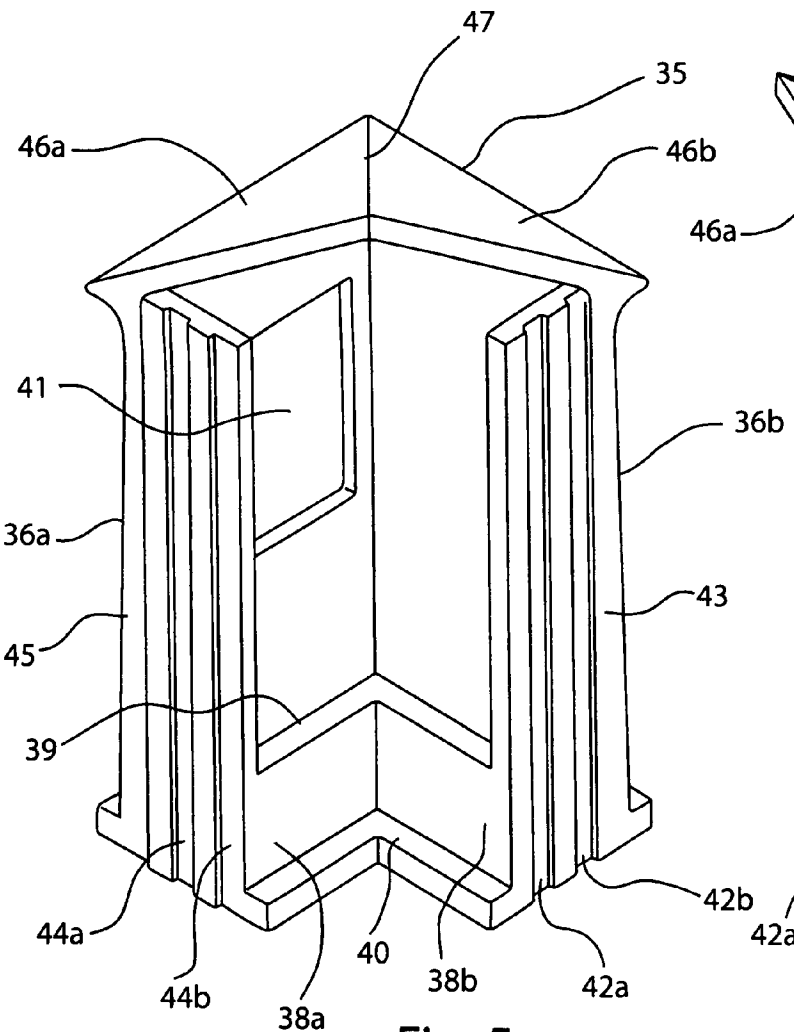
FIG. 5 is an inside perspective view of a corner panel

A corner panel 35 is illustrated in FIG. 5 and FIG. 6. It comprises exterior walls 36*a* and 36*b*, which join one another at a right angle forming corner 37. Interior walls 38*a* and 38*b* extends up to the floor level 39, above footer 40. A window 41 is formed in exterior wall 36*a*. Channels 42*a* and 42*b* are formed in side 43, parallel to side 36*b*. Channels 44*a* and 44*b* are formed in side 45, parallel to side 36*a*. Roof portion 46*a* and 46*b* are joined at angled corner 47 and extend upwardly from sides 36*a* and 36*b*.

A beam 48 has two support legs 49*a* and 49*b*, which extend downwardly and outwardly from the support surface 50. Legs 49*a* and 49*b* at angled end portions 51*a* and 51*b*. Triangular notches 52*a* and 52*b* are to accommodate horizontal triangular beams, not shown.

Figure 8:
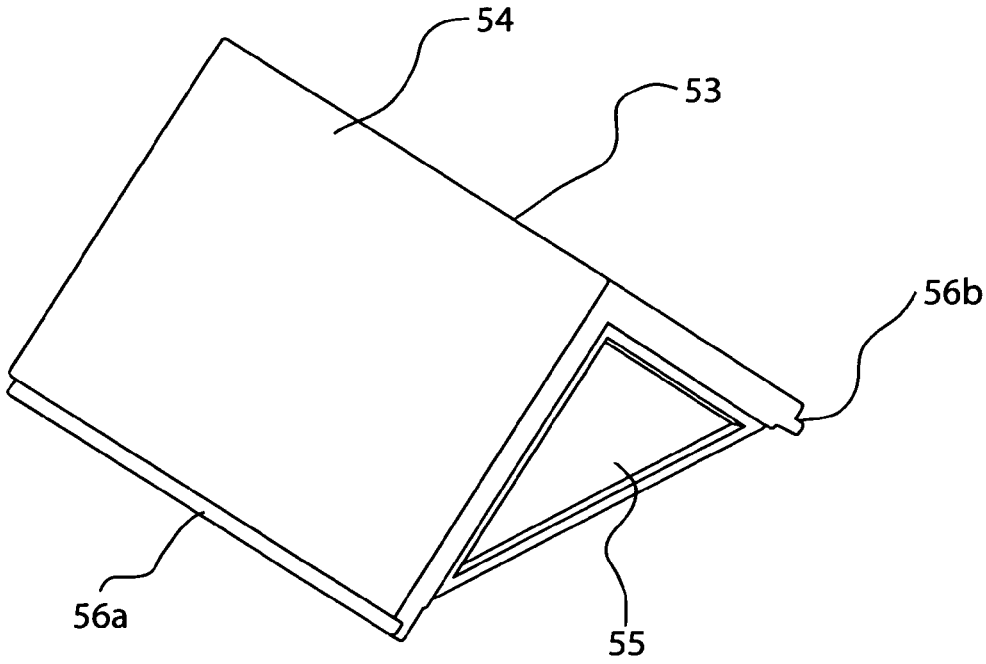
FIG. 8 is a side perspective view of a roof panel

A roof panel 53 shown in FIG. 8, comprises a triangular roof 54, with passageway 55 formed thereunder. The roof 54 has underlaps 56*a* and 56*b* formed to accommodate the overlaps 9 on the center panel roof.

Figure 9:
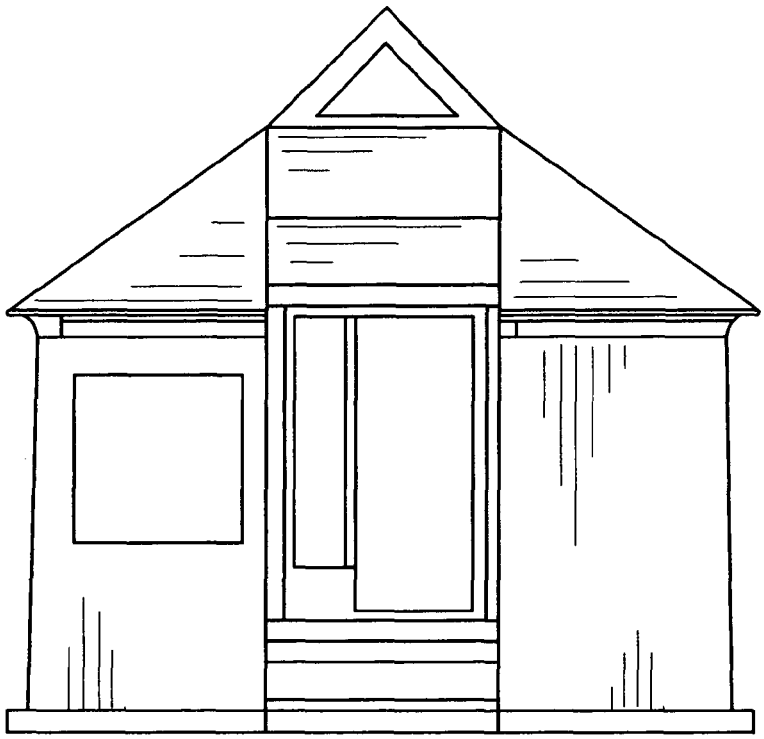
FIG. 9 is front view of a small configuration of assembled panels
Figure 10:
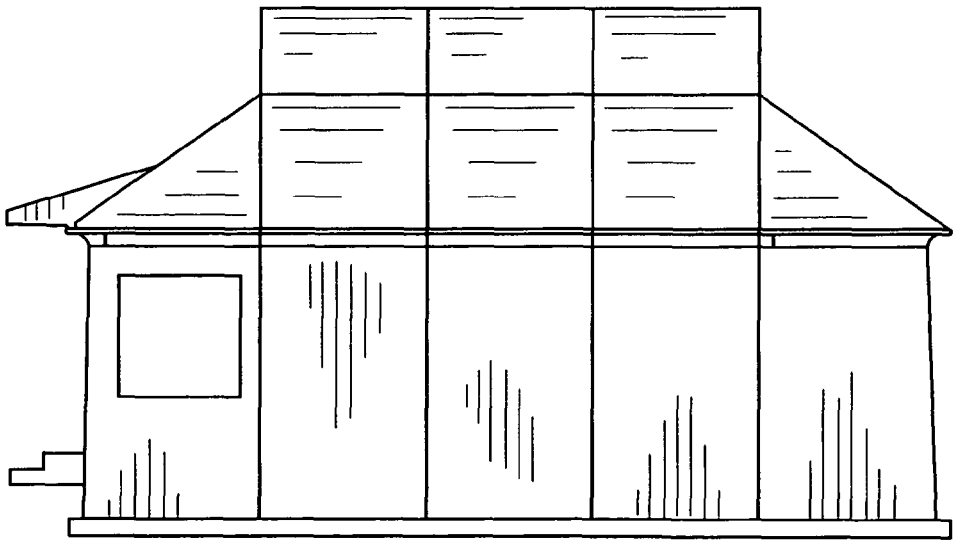
FIG. 10 is a side view of a small configuration of assembled panels
Figure 11:
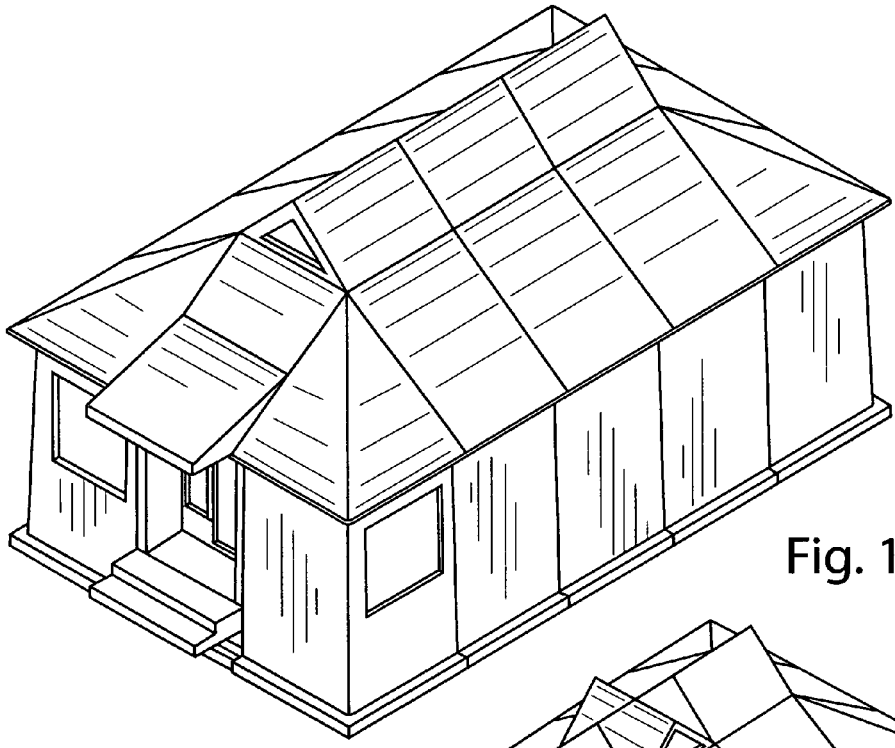
FIG. 11 is a side perspective view of a medium sized configuration of assembled panels
Figure 12:
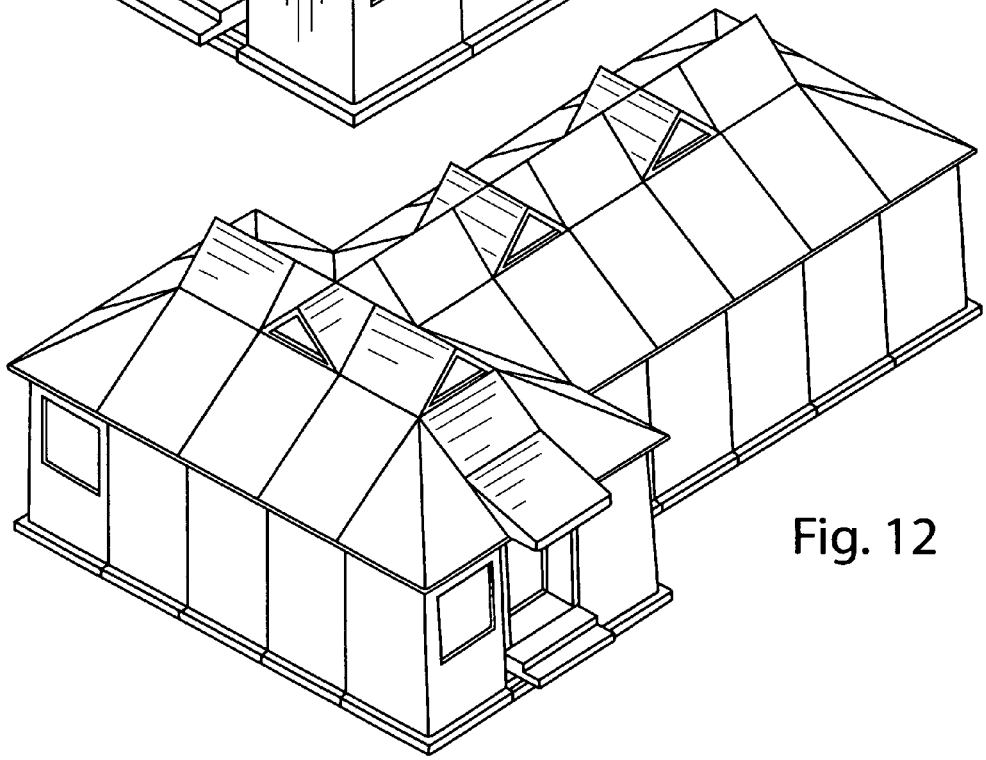
FIG. 12 is a side perspective view of a large configuration of assembled panels
Figure 13:
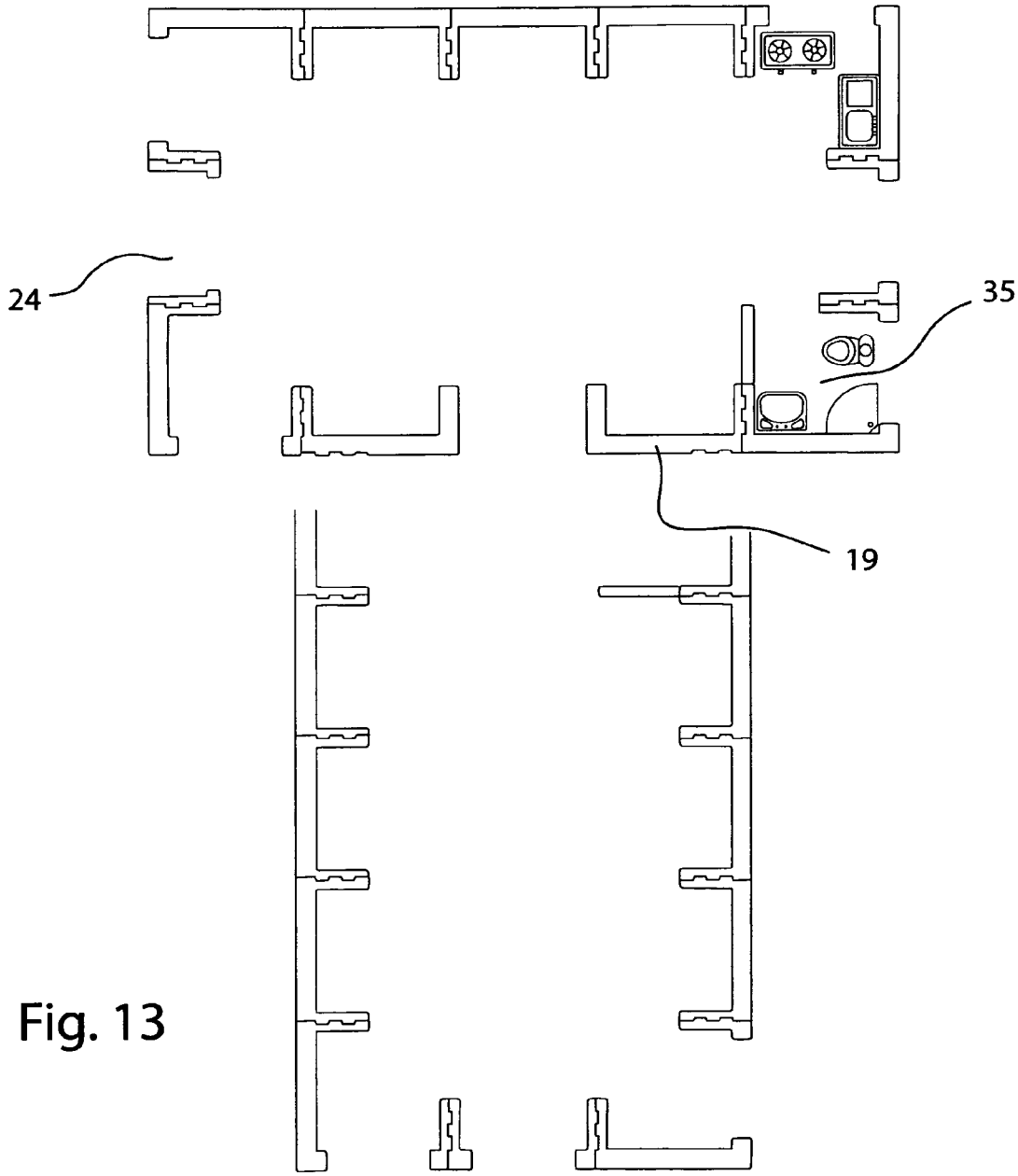
FIG. 13 is a floor plan of the configuration shown in FIG. 12

FIGS. 9. through 12 show the panels in various configurations, including simple (FIGS. 9, 10 and 11), and combination (FIG. 12). FIG. 13 is a floorplan of the structure shown in FIG. 12.

Figure 7:
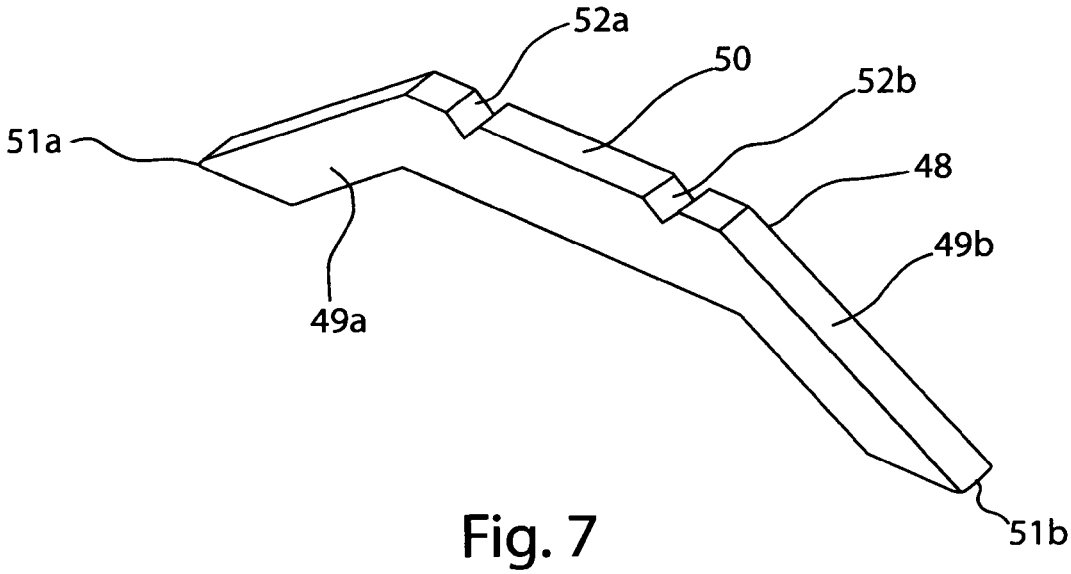
FIG. 7 is a side perspective view of a beam
Figure 14:
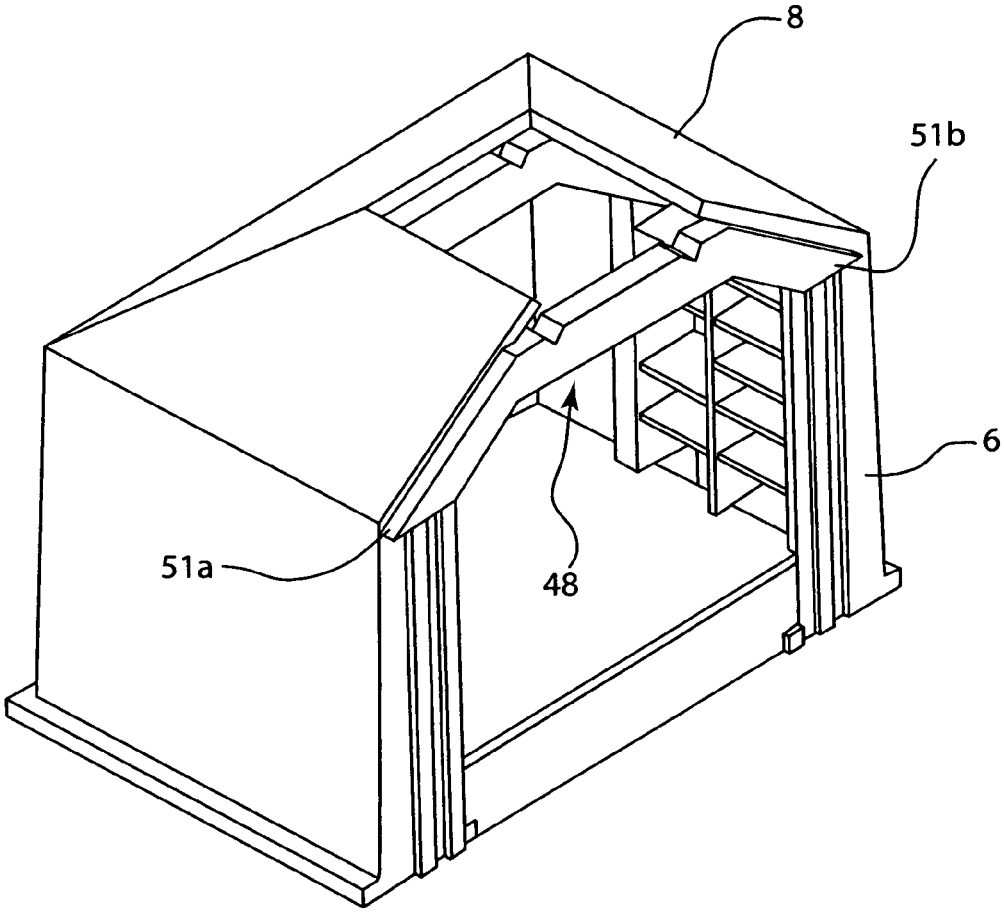
FIG. 14 is an exemplary subunit of the inventive modular construction system showing the beam 48 depicted in FIG. 7 spanning the distance opposing panels.

FIG. 14 is an exemplary subunit of the inventive modular construction system showing the beam 48 depicted in FIG. 7 spanning the distance opposing panels. The beam 48 ties opposing panels together, thereby ensuring the structural integrity of the unit, and provides support for the roof panel 53 (not shown).

The principles, preferred embodiments and modes of operation of the present invention have been described in the foregoing specification. However, the invention should not be construed as limited to the particular embodiments which have been described above. Instead, the embodiments described here should be regarded as illustrative rather than restrictive. Variations and changes may be made by others without departing from the scope of the present invention as defined by the following claims:

What I claim is:

1. A modular building construction system comprising:

a plurality of center, corner, interior passageway, door, and roof panels, and beams;

said center panels comprising opposing rectilinear sides having generally the same first height and first width, said rectilinear sides being positioned adjacent an exterior rectilinear wall having said first height and a second width and an interior structural rectilinear wall having a second height and said second width, said rectilinear sides and walls mounted to a footing having lateral projections, and a roof panel covering said rectilinear sides and said walls, said roof panel defining a slope downwards towards an exterior rectilinear wall;

said corner panels comprising two adjacent exterior rectilinear walls having said first height and a width forming a perpendicular corner, adjacent rectilinear sides having said first height and said first width, and adjacent interior structural rectilinear walls having said second height forming a perpendicular corner congruent with said perpendicular corner formed by said adjacent exterior rectilinear walls, said adjacent exterior rectilinear walls, said adjacent rectilinear sides, and said adjacent interior structural rectilinear walls mounted to a footing having lateral projections, and adjacent roof panels covering said adjacent exterior rectilinear walls, said adjacent rectilinear sides, and said adjacent interior structural rectilinear walls, said adjacent roof panels defining a slope downwards towards said adjacent exterior rectilinear walls;

said interior passageway panels comprising opposing rectilinear passageway panel sides having said first height and said first width, said rectilinear sides being positioned adjacent an exterior rectilinear passageway panel wall having said first height and said second width and an interior structural rectilinear passageway panel wall having said second height and said second width, said passageway panel sides and passageway panel walls mounted to a passageway panel footer having a lateral projection, and a passageway roof panel covering said passageway panel sides and said passageway panel walls, said passageway panel roof defining a slope downwards towards said exterior rectilinear passageway panel wall;

said door panels comprising opposing rectilinear door panel sides having said first height and said first width, said rectilinear door panel sides being positioned adjacent an interior rectilinear door panel wall having a third height and said second width, said door panel sides and door panel wall being mounted to a door panel footer having lateral projections, a door panel roof panel defining abutting first and second planes covering said door panel sides and said door panel wall, said first plane defining a slope having a first angle downwards from said interior rectilinear door panel wall and said second plane defining a slope having a second angle upwards from said first plane, said second plane angle being greater than said first plane angle, said interior rectilinear door panel wall having an inset door or passageway;

said roof panels comprising rectilinear planar roof portions joined at an angled corner forming a gabled roof peak;

said beams comprising a horizontal support surface having legs extending downwardly at the same angle as said roof panel;

said panels being abuttable to form buildings in arbitrary shapes wherein complimentary longitudinal channels formed in said rectilinear sides facilitate weatherproof joining of said sides; and, said panels and beams being joinable in arbitrary configurations to form weatherproof enclosed structures.

2. A modular building construction system as claimed in claim 1 wherein at least one window is formed in at least one of said center, corner, or door panels.

3. A modular building construction system as claimed in claim 1 wherein entry steps abut the base of said door panels.

4. A modular building construction system as claimed in claim 1 wherein said roof panels are lap joined to said center, corner, interior passageway, or door panels.

5. A modular building construction system as claimed in claim 1 wherein shelves are mounted in the space defined by said sides and said walls of said center panels.

6. A modular building construction system comprising:

a plurality of molded polymer material center, corner, interior passageway, door, and roof panels, and beams;

said center panels comprising opposing rectilinear sides having substantially the same first height and first width, said center panels being positioned adjacent an exterior rectilinear wall having said first height and a second width and an interior structural rectilinear wall having a second height and said second width, said sides and walls being mounted to a footing having lateral projections, and a roof panel covering said sides and said walls, said roof panel defining a slope downwards towards said exterior rectilinear wall;

said corner panels comprising two adjacent exterior rectilinear walls having said first height and a width forming a perpendicular corner, adjacent rectilinear sides having said first height and said first width, and adjacent interior structural rectilinear walls having said second height forming a perpendicular corner congruent with said perpendicular corner formed by said adjacent exterior rectilinear walls, said adjacent exterior rectilinear walls, said adjacent rectilinear sides, and said adjacent interior structural rectilinear walls mounted to a footing having lateral projections, and a roof structure integrally formed with said adjacent exterior rectilinear walls covering said adjacent exterior rectilinear walls, said adjacent rectilinear sides, and said adjacent interior structural rectilinear walls, said roof structure defining adjacent roof portions defining a slope downwards towards said adjacent exterior rectilinear walls;

said interior passageway panels comprising opposing rectilinear passageway panel sides having said first height and said first width, said rectilinear sides being positioned adjacent an exterior rectilinear passageway panel wall having said first height and said second width and an interior structural rectilinear passageway panel wall having said second height and said second width, said passageway panel sides and passageway panel walls mounted to a passageway panel footer having a lateral projection, and a passageway panel roof panel covering said passageway panel sides and said passageway panel walls, said passageway panel roof defining a slope downwards towards said exterior rectilinear passageway panel wall;

said door panels comprising opposing rectilinear door panel sides having said first height and said first width, said rectilinear door panel sides being positioned adjacent an interior rectilinear door panel wall having a third height and said second width, said door panel sides and door panel wall being mounted to a door panel footer having lateral projections, a door panel roof panel defining abutting first and second planes covering said door panel sides and said door panel wall, said first plane defining a slope having a first angle downwards from said interior rectilinear door panel wall and said second plane defining a slope having a second angle upwards from said first plane, said second plane angle being greater than said first plane angle, said interior rectilinear door panel wall having an inset door or passageway;

said roof panels comprising rectilinear planar roof portions joined at an angled corner forming a gabled roof peak;

said beams comprising a horizontal support surface having legs extending downwardly at the same angle as said roof panel;

said panels being abuttable to form buildings in arbitrary shapes wherein complimentary longitudinal channels formed in said rectilinear sides facilitate weatherproof joining of said sides; and, said panels and beams being joinable in arbitrary configurations to form weatherproof enclosed structures.

7. A modular building construction system as claimed in claim 6 wherein said molded polymer material is extruded or expanded polystyrene.

8. A modular building construction system as claimed in claim 6 wherein at least one window is formed in said center, corner, or door panels.

9. A modular building construction system as claimed in claim 6 wherein entry steps abut the base of said door panels.

10. A modular building construction system as claimed in claim 6 wherein said roof panels are lap joined to said center, corner, interior passageway, or door panels.

11. A modular building construction system as claimed in claim 6 wherein shelves are mounted in the space defined by said sides and said walls of said center panels.

12. A method for constructing a building comprising:

forming a plurality of modular free standing building components of molded polymer material chosen from a group consisting of center, corner, interior passageway, and door panels, each panel having a preformed structure with preformed unitary sections and said corner panels having a preformed right angle forming the corner with an overlying integral roof;

forming a plurality of modular roof panels;

forming a plurality of beam structures with legs extending downwardly;

arbitrarily joining and securing said center, corner, interior passageway, and door panels together by fitting mated panel side surfaces together to enclose a space;

attaching said beam structures to the upper portions of said center, corner, interior passageway, and door panels; and, mounting said roof panels to said beam structures to create a weatherproof enclosed space.

13. The method for constructing a building as claimed in claim 12 further wherein said molded polymer panels are formed from extruded or expanded polystyrene.

* * * * *